US006303887B1

(12) United States Patent
Ando

(10) Patent No.: US 6,303,887 B1
(45) Date of Patent: Oct. 16, 2001

(54) PUSHBUTTON SWITCH ELEMENT FOR PUSHBUTTON SWITCH STRUCTURE

(75) Inventor: Hitoshi Ando, Saitama (JP)

(73) Assignee: Shin-Etsu Polymer Co., Ltd. (JP)

( * ) Notice: Subject to any disclaimer, the term of this patent is extended or adjusted under 35 U.S.C. 154(b) by 0 days.

(21) Appl. No.: 09/793,806

(22) Filed: Feb. 23, 2001

(51) Int. Cl.[7] ..... H01H 13/70
(52) U.S. Cl. ..... 200/512; 200/516; 200/1 B
(58) Field of Search ..... 200/1 B, 5 A, 200/512, 513, 516, 517, 341

(56) References Cited

U.S. PATENT DOCUMENTS

| | | | | |
|---|---|---|---|---|
| 4,652,704 | * | 3/1987 | Franklin | 200/5 A |
| 5,559,311 | * | 9/1996 | Gorbatoff | 200/513 |
| 5,717,176 | * | 2/1998 | Dahlstrom | 200/1 B |
| 5,824,978 | * | 10/1998 | Karasik et al. | 200/1 B |
| 5,952,629 | * | 9/1999 | Yoshinaga et al. | 200/5 A |

* cited by examiner

*Primary Examiner*—Michael Friedhofer
(74) *Attorney, Agent, or Firm*—Lerner, David, Littenberg, Krumholz & Mentlik, LLP

(57) ABSTRACT

A pushbutton switch element for a pushbutton switch structure capable of generating a click in a multistage manner which is felt by a user and reducing sound generation during a pressing operation, as well as reducing generation of resonance sound. The pushbutton switch element includes a dome section, a pushbutton section formed on an upper portion of a center of the dome section, a central movable contact arranged so as to downwardly extend from a lower surface of the pushbutton section, a substantially annular movable contact arranged so as to downwardly extend from the lower surface of the pushbutton section and surround the central movable contact while being spaced from the central movable contact at a predetermined interval, an inverted cup-like member adhesively attached to a distal end of the central movable contact and constructed so as to repeatedly carry out a flex operation between a flexed state and an original state restored from the flexed state while concurrently generating a click which is felt by a user.

18 Claims, 8 Drawing Sheets

PUSHBUTTON SWITCH ELEMENT FOR PUSHBUTTON SWITCH STRUCTURE

BACKGROUND OF THE INVENTION

This invention relates to a pushbutton switch element for a pushbutton switch structure used for electronic equipment, a portable terminal, an automobile component or the like, and more particularly to a pushbutton switch element for a pushbutton switch structure suitable for use for equipment such as a power window switch for an automobile or the like which is required to carry out an on-off operation of an electric circuit thereof in a multistage manner while generating a click in a multistage manner which is felt by a user.

A mechanical switch has been conventionally used as a switch which generates a click in a multistage way or manner which is felt by a user. Such a mechanical switch is constructed in such a manner as shown in FIG. 7A by way of example. There is also known another conventional mechanical switch which is constructed as shown in FIG. 8.

The conventional mechanical switch shown in each of FIGS. 7A and 8 is typically used for an electronic instrument such as an electronic piano, a power window switch for an automobile or the like so as to generate a click which is felt by a user or carry out electrical connection in a multistage manner.

The conventional mechanical switch generally designated by reference numeral 101 in FIG. 7A includes a housing 101*a*, a leaf spring 101*b*, a pressing force transmission member 101*c*, a spring 101*d*, a lead frame 101*e* and a base plate 101*f*. The leaf spring 101*b* is provided with a projection 101$b_1$ and the pressing force transmission member 101*c* is provided with two recesses 101$c_1$ and 101$c_2$. Locked fitting of the projection 101$b_1$ of the leaf spring 101*b* in each of the recesses 101$c_1$ and 101$c_2$ of the pressing force transmission member 101*c* permits slide resistance or friction resistance between the leaf spring 101*b* and the pressing force transmission member 101*c* to be different from that therebetween obtained when the locked fitting is not carried out, so that the mechanical switch may generate a click which is felt by a user. The mechanical switch of FIG. 7A thus constructed exhibits a load curve shown in FIG. 7B, wherein a point $F_1$ indicates a click generated during first fitting of the recess 101$c_1$ on the projection 101$b_1$ and a point $F_2$ indicates a click generated during second fitting of the recess 101$c_2$ on the projection 101$b_1$.

The conventional mechanical switch 102 generally designated by reference numeral 102 in FIG. 8 includes a housing 102*a*, a frame 102*b*, a slide member 102*c* made of a plastic material, a spring 102*d* made of metal, plungers 102*e*, a cover member 102*f* made of an elastomer material, a key top 102*g* made of a resin material and a base plate 102*h*. Thus, the mechanical switch 102 is constituted by seven members made of plastic materials, the metal spring and the base plate to generate a click like that of the mechanical switch 101 described above. In the mechanical switch 102, mechanical locking among the plastic members by fitting permits the mechanical switch 102 to generate a click which is felt by a user due to resistance to movement among the members. The mechanical switch 102 exhibits substantially the same load curve as that shown in FIG. 7B.

In addition, there is used a press switch which is made of a silicone rubber material and constructed so as to generate a click in a multistage manner which is felt by a user. In general, a pushbutton switch made of a silicone rubber material attains a switching operation while being reduced in the number of parts, resulting in it being commonly used for a variety of pushbutton switch equipment such as an electronic calculator, a word processor, a remote controller and the like.

Now, a conventional pushbutton switch cover made of a silicone rubber material and adapted to be used for a word processor will be described with reference to FIGS. 9A and 9B.

A pushbutton switch cover 103 for a pushbutton switch structure is integrally formed so as to generate a click in a two-stage manner which is felt by a user and made of a rubber-like elastic material represented by silicone rubber. In FIG. 9A, only one pushbutton switch is illustrated. The pushbutton switch cover 103 includes a cylindrical rib 103*a* arranged so as to be positioned at a top of the pushbutton switch, a first dome-like section 103*b* for generating a first click at a point $F_1$ (FIG. 9B), a second dome-like section 103*c* of a thin wall arranged at a central position of the pushbutton switch so as to generate a second click at a point $F_2$, and a projection 103$b_2$ formed so as to downwardly project from a ceiling of the second dome-like section 103*c* and provided on a lower surface thereof with a contact 103$b_1$. The rib 103*a* and thin-wall dome sections 103*b* and 103*c* are flexed in order by pressing a pushbutton, to thereby generate a click in a two-stage manner which is felt by a user. The pushbutton switch thus constructed is mainly used for a key board for a word processor intended to prevent thecitis.

In the past, a switch such as a power window switch for an automobile or the like which is demanded not only to exhibit two or more switching functions but to generate an enhanced click which is felt by a user (a click ratio being typically as high as 30% or more) generally is necessarily required to use a mechanical switch (tactile switch) mechanism which utilizes slide resistance due to a combination of functional parts. Also, the mechanical switch shown in FIG. 8 is increased in the number of parts and complicated in structure, to thereby cause generation of rebound sound or contact sound during sliding of the parts and returning of the button, as well as resonance sound due to external vibration such as vibration of an engine of an automobile. Also, a so-called rubber switch such as the switch shown in FIG. 9A which exhibits two or more conductive functions fails to generate a click sufficient to permit a user or operator to recognize turning-on of the switch carried out twice by the feel.

This is due to the fact that the click is generated only by both deformation and restoration of the rib 103*a* and dome sections 103*b* and 103*c* which are made of a thin-wall rubber-like elastic material. In other words, this is due to the fact that the click is generated by impact resilience of the elastic material and restriction of a configuration of the dome sections determined depending on a material therefor.

SUMMARY OF THE INVENTION

The present invention has been made in view of the foregoing disadvantage of the prior art.

Accordingly, it is an object of the present invention to provide a pushbutton switch element for a pushbutton switch structure which is capable of generating a distinct click in a multistage manner which is felt by a user and reducing generation of sound during operation of a pushbutton as well as reducing generation of resonance sound.

In accordance with the present invention, a pushbutton switch element for a pushbutton switch structure is provided. The pushbutton switch element includes a movable thin wall section and a pushbutton section formed on an upper portion of a center of the movable thin wall section, and a first movable contact arranged so as to downwardly extend from a lower surface of the pushbutton section. The pushbutton switch element further includes a second movable contact having a substantially annular shape and arranged so as to downwardly extend from the lower surface of the pushbutton section and surround the first movable contact while being spaced from the first movable contact at a predetermined interval, and an inverted cup-like member adhesively attached to a distal end of the first movable contact and constructed so as to repeatedly carry out a flex operation between a flexed state and an original state restored from the flexed state while concurrently generating a click which is felt by a user.

In a preferred embodiment of the present invention, the second movable contact is formed to be an annular shape in a continuous manner.

In a preferred embodiment of the present invention, the second movable contact is formed to be a substantially annular shape in an intermittent manner.

In a preferred embodiment of the present invention, the inverted cup-like member is made of metal.

In a preferred embodiment of the present invention, the inverted cup-like member is made of synthetic resin.

In a preferred embodiment of the present invention, the movable thin wall section and the pushbutton section are integrally molded of a rubber elastomer material.

In a preferred embodiment of the present invention, the movable thin wall section is configured to have a dome-like shape.

In a preferred embodiment of the present invention, the first movable contact downwardly extends beyond the second movable contact.

In a preferred embodiment of the present invention, the second movable contact downwardly extends beyond the first movable contact.

In a preferred embodiment of the present invention, the first and second movable contacts downwardly extend to substantially the same level.

The above-described construction of the present invention, when the inverted cup-like member is arranged at a high position in the thin wall section, permits the pushbutton switch element to generate a first click due to deformation of the thin wall section as the pushbutton section is lowered. Also, further lowering or downward pressing of the pushbutton section permits the inverted cup-like member to come into contact with a base plate on which the thin wall section is supported and to be flexed, so that the pushbutton switch element may generate a second click. In this instance, when the inverted cup-like member is made of metal or provided with a contact pattern formed thereon and first fixed contacts are arranged on the base plate, and the second movable contact of a substantially annular shape formed in a continuous or intermittent manner is arranged at a height which permits the second movable contact to come into contact with second fixed contacts arranged on the base plate, the pushbutton switch may carry out a switching operation every time the first and second clicks are generated.

When the inverted cup-like member is at a low position in the thin wall section, downward pressing of the pushbutton section permits the inverted cup-like member to generate a first click. Further lowering of the pushbutton section permits a second click to be generated due to deformation of the thin wall section.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a pushbutton switch element for a pushbutton switch structure according to the present invention will be described with reference to FIGS. 1A to 4B.

Figure 1A:
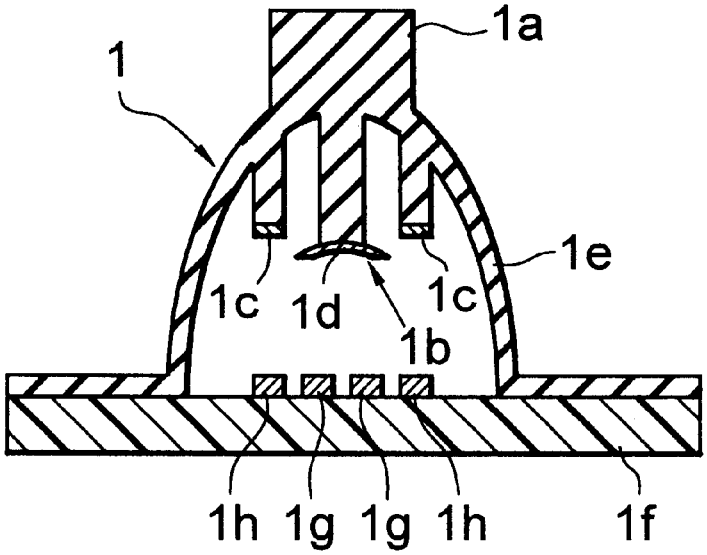
FIG. 1A is a sectional view showing a first embodiment of a pushbutton switch element for a pushbutton switch structure according to the present invention.
Figure 1B:
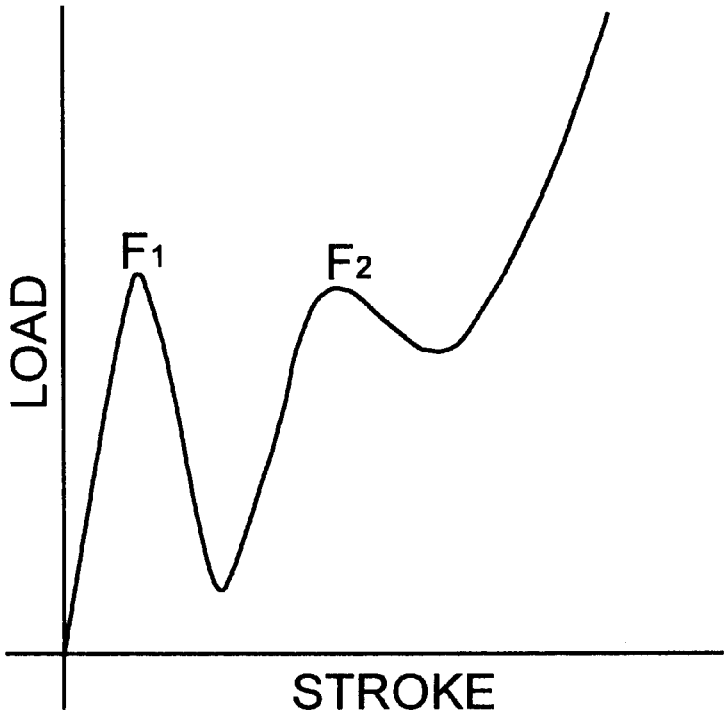
FIG. 1B is a graphical representation showing a load curve obtained by the pushbutton switch element shown in FIG. 1A.

Referring first to FIGS. 1A and 1B, a first embodiment of a pushbutton switch element for a pushbutton switch structure according to the present invention is illustrated. A pushbutton switch element of the illustrated embodiment which is generally designated by reference numeral 1 generally includes a pressing section or pushbutton section 1*a*, a first movable contact 1*b* provided with an inverted cup-like member 1*d*, a second movable contact 1*c*, and a movable thin wall section or dome section 1*e*. The pushbutton switch element 1 is generally made of a rubber elastomer material suitably selected from the group consisting of natural rubber, urethane rubber, EPDM, silicone rubber, a thermoplastic elastomer containing a lot of soft segments so as to exhibit increased flexibility, and the like. Silicone rubber is preferably selected in view of precision forming properties, environmental resistance, non-toxicity and the like.

In the illustrated embodiment, it is not necessarily required that the pressing section 1*a* be provided on a top surface thereof with a movable rib, unlike a conventional pushbutton switch element made of a rubber elastomer and constructed so as to generate a click in a multistage manner which is felt by a user. Thus, the pressing section 1*a* of the pushbutton switch element 1 may be arranged so as to be exposed directly from equipment into which the pushbutton switch element is incorporated, resulting in it acting as a pushbutton section. In this instance, the pressing section 1*a* may be formed thereon with a character and the like by screen printing, pad printing or the like. Alternatively, the pushbutton switch element 1 may be made of a transparent material, wherein the pressing section 1*a* is formed on each of a side surface and the top surface thereof with a light-blocking layer, which may be made of a black paint or the like. Then, the light-blocking layer on the top surface of the pressing section 1*a* is partially irradiated with a laser beam, to thereby be partially burnt off into a desired configuration, so that the pushbutton switch element of the illustrated embodiment may be of the character back-lighting type. Also, when the pushbutton switch element 1 is desired to give a hard touch to a user's finger, the top surface of the pressing section 1*a* made of a rubber elastomer material may have a resin plate which has a Shore D hardness of 40 or more attached thereto by means of an adhesive.

The pressing section 1*a* is not limited to any specific configuration. Thus, it may be formed to have any suitable shape such as a cylindrical shape, a parallelopiped shape, an elliptic cylindrical shape or the like as employed in the prior art.

The pushbutton switch element 1 of the illustrated embodiment is provided on a lower surface thereof with at least two movable contacts or the movable contacts 1*b* and 1*c* which are downwardly projected therefrom. One of the movable contacts or the first movable contact 1*b* is arranged at a substantially central portion of the pushbutton switch so as to act as a central movable contact. The other movable contact or second movable contact 1*c* is arranged around the central movable contact 1*b* so as to surround it while being kept spaced therefrom at a predetermined interval, resulting in the second movable contact 1*c* serving as a substantially annular movable contact. Correspondingly, a substrate or base plate 1*f* is provided thereon with first and second fixed contacts 1*g* and 1*h*. In the illustrated embodiment, the central movable contact 1*b* is formed so as to downwardly extend by a long distance as compared with the annular movable contact 1*c*, so that the inverted cup-like member 1*d* may generate a click which is felt by a user at a point $F_1$ shown in FIG. 1B and the dome section 1*e* may generate a click at a point $F_2$.

The inverted cup-like member 1*d* is adhesively attached to a distal end of the central movable contact 1*b* so as to generate an enhanced click. The inverted cup-like member 1*d* may be formed of a dish-shaped metal spring made of phosphor bronze or stainless steel, a thermoplastic elastomer having plenty of hard segments compounded therein, or the like. However, it may be formed of any other suitable material so long as the material permits the inverted cup-like member 1*d* to generate a click as high as 30% or more of a click ratio when it is pressed. The dish-shaped spring used may be formed to have any desired size. In this instance, when the inverted cup-like member 1*d* is made of an thermoplastic elastomer, a contact pattern may be formed of a conductive ink on an inner surface of the inverted cup-like member 1*d*.

The substantially annular movable contact 1*c* may be formed of a conductive ink by printing. Alternatively, it may be molded integrally with a conductive chip formed to have a desired shape. The term "substantially annular shape" used herein includes a ring-like shape, as well as a rectangular frame-like shape, a triangular frame-like shape and the like. Thus, it will be noted that it means any configuration which permits the substantially annular movable contact 1*c* to surround the central movable contact 1*b* with a predetermined or constant interval being defined therebetween. Also, the substantially annular movable contact 1*c* is not necessarily required to be formed in a continuous pattern such as a continuous ring-like pattern, a continuous rectangular frame-like pattern or the like. In other words, it may be formed in an intermittent annular pattern. Thus, the substantially annular movable contact 1*c* may be constituted by a plurality of movable contact elements formed to have substantially the same height or length and arranged so as to surround the central movable contact 1*b*.

The pushbutton switch element 1 of the illustrated embodiment may be typically constructed so as to generate a click in a two-stage manner which is felt by a user and concurrently carry out electrical connection in a two-stage manner. Alternatively, it may be configured so as to carry out electrical connection in a three-stage manner. This may be attained by arranging the substantially annular movable contact 1*c* in a double-circle pattern defined by two circles different in height by way of example. Also, it may be configured so as to generate a click in a three-stage manner. This may be accomplished by forming a rib on a top surface of the pressing section 1*a* as in the prior art. When it is desired that the pushbutton switch element 1 of the illustrated embodiment generate an initial click at a high level, it may be made of a thermoplastic elastomer increased in impact resilience to a level as high as, for example, 60% or more and reduced in hardness to a level as low as, for example, Shore A hardness of 70 or less, and formed to have a dome-like shape by injection molding.

Figure 2A:
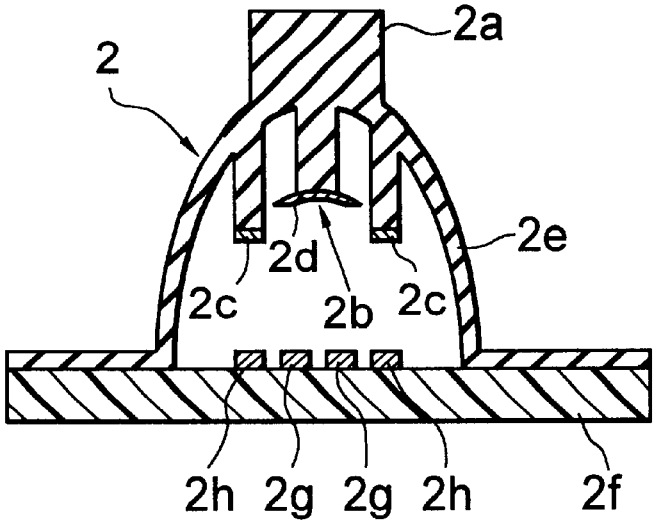
FIG. 2A is a sectional view showing a second embodiment of a pushbutton switch element for a pushbutton switch structure according to the present invention.
Figure 2B:
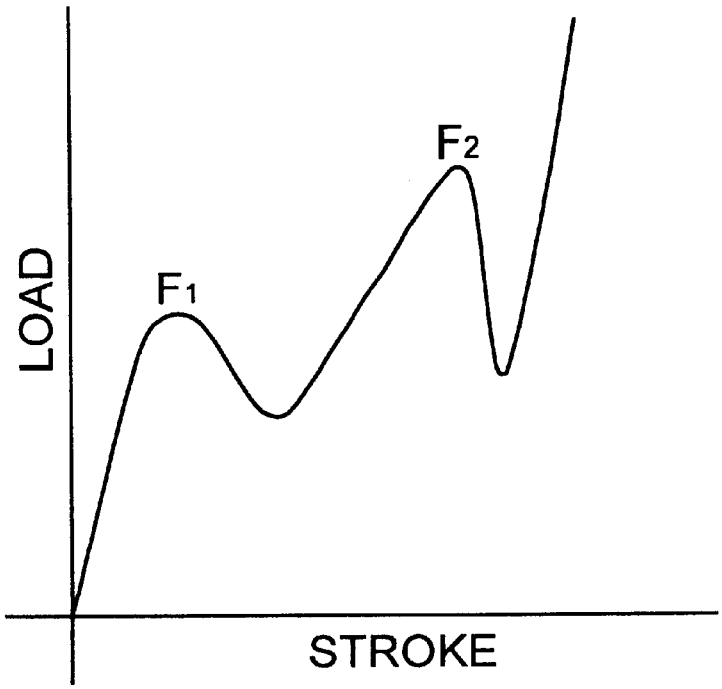
FIG. 2B is a graphical representation showing a load curve obtained by the pushbutton switch element shown in FIG. 2A.

Referring now to FIGS. 2A and 2B, a second embodiment of a pushbutton switch element for a pushbutton switch structure according to the present invention is illustrated. A pushbutton switch element of the illustrated embodiment generally designated by reference numeral 2 is so constructed that a substantially annular movable contact 2*c* is formed so as to downwardly extend by an increased length as compared with a central movable contact 2*b*, so that an inverted cup-like member 2*d* may generate a click at a point $F_2$ (FIG. 2B) and a dome section 2*e* may generate a click at a point $F_1$. The remaining part of the illustrated embodiment may be constructed in substantially the same manner as the first embodiment described above. Reference characters 2*a*, 2*f*, 2*g* and 2*h* designate a pressing section, a base plate, a first fixed contact, and a second fixed contact, respectively.

Figure 3A:
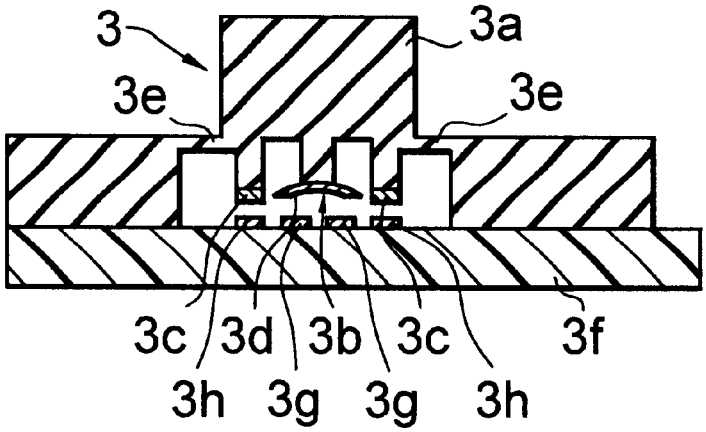
FIG. 3A is a sectional view showing a third embodiment of a pushbutton switch element for a pushbutton switch structure according to the present invention.
Figure 3B:
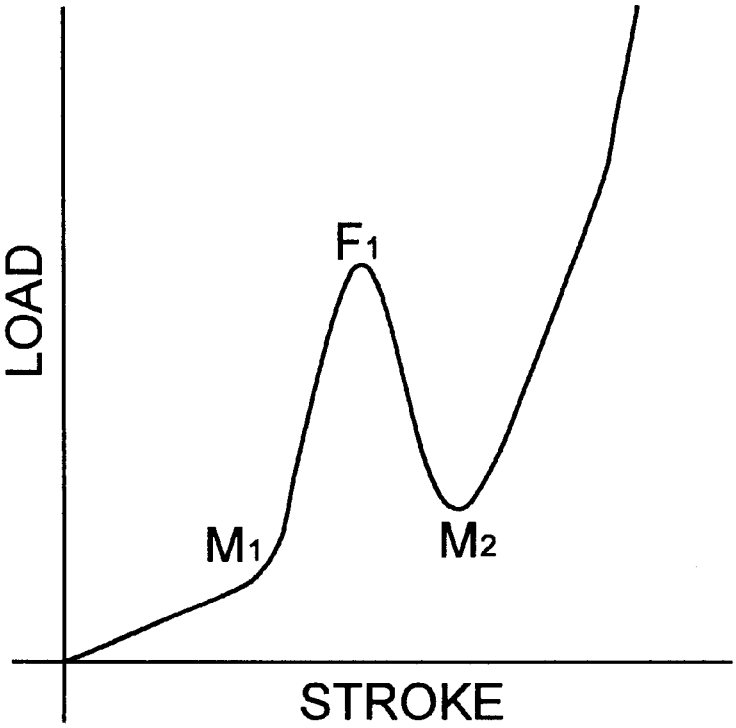
FIG. 3B is a graphical representation showing a load curve obtained by the pushbutton switch element shown in FIG. 3A.

Referring now to FIGS. 3A and 3B, a third embodiment of a pushbutton switch element for a pushbutton switch structure according to the present invention is illustrated. A pushbutton switch element of the illustrated embodiment generally designated by reference numeral 3 is so constructed that a central movable contact 3*b* and a substantially annular movable contact 3*c* are formed so as to downwardly extend to substantially the same level or terminate at substantially the same level, so that the substantially annular movable contact 3*c* may be turned on or conductive at a point $M_1$ (FIG. 3B) and an inverted cup-like member 3*d* may generate a click at a point $F_1$ and conductive at a point $M_2$. Each of the characters "$M_1$" and "$M_2$" in FIG. 3B indicates make load and is a point at which the switch carries out an electrical switching operation. The remaining part of the illustrated embodiment may be constructed in substantially the same manner as the first embodiment described above. Reference characters 3*a*, 3*e*, 3*f*, 3*g* and 3*h* designate a pressing section, a thin wall section, a base plate, a first fixed contact, and a second fixed contact, respectively.

Figure 4A:
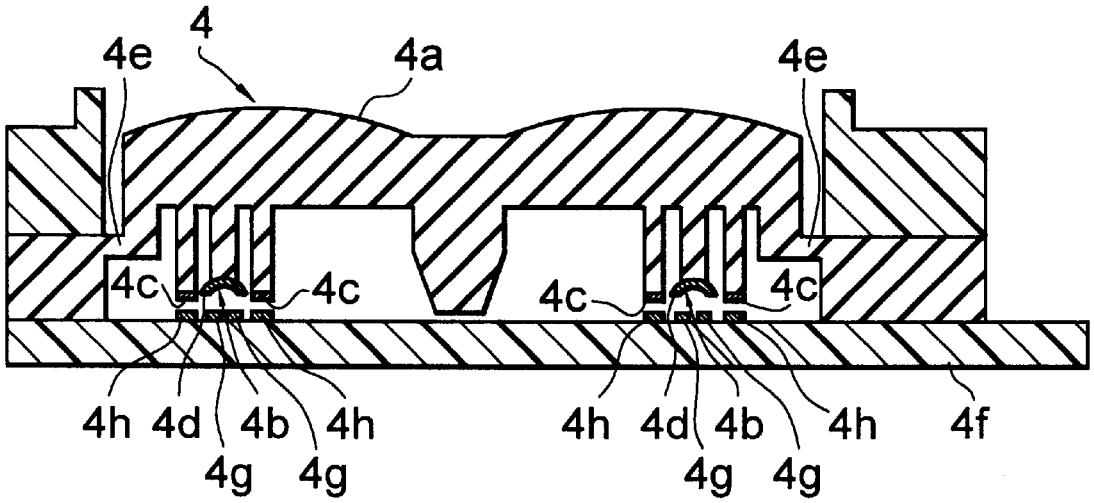
FIG. 4A is a sectional view showing a fourth embodiment of a pushbutton switch element according to the present invention, which is applied to a power window switch structure for an automobile.
Figure 4B:
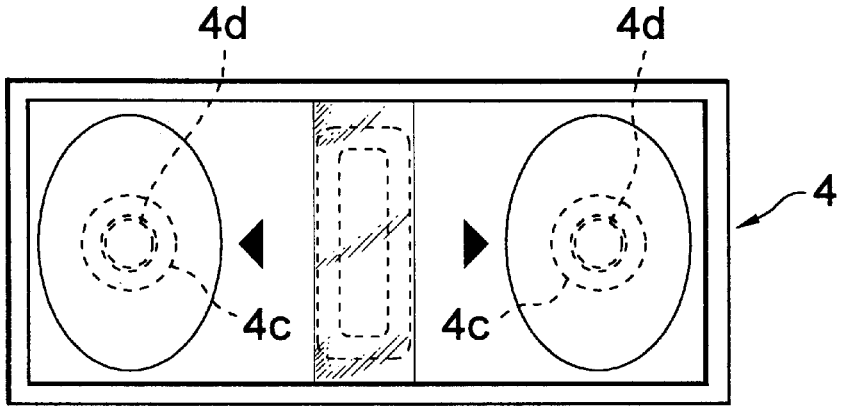
FIG. 4B is a plan view of the power window switch structure shown in FIG. 4A.

Referring now to FIGS. 4A and 4B, a further embodiment of a pushbutton switch element for a pushbutton switch structure according to the present invention, which is applied to a power window switch structure for an automobile, is illustrated. A pushbutton switch element of the illustrated embodiment generally designated by reference numeral 4 is so constructed that a pair of switching mechanisms are symmetrically arranged therein. In each of the switching mechanisms, a central movable contact 4*b* provided with an inverted cup-like member 4*d* and a substantially annular movable contact 4c are formed so as to downwardly extend to substantially the same level from a lower surface of a pressing section 4*a*. The remaining part of the illustrated embodiment may be constructed in substantially the same manner as the third embodiment described above. Reference characters 4*e*, 4*f*, 4*g* and 4*h* designate a thin wall section, a base plate, a first fixed contact, and a second fixed contact, respectively.

As can be seen form the foregoing, the pushbutton switch element of the present invention generates a distinct click in a multistage manner which is felt by a user and minimizes generation of sound during pressing operation of the switch which the prior art fails to reduce. Also, the pushbutton switch element of the present invention attains a reduction in resonance sound generated due to driving of an engine of a vehicle when it is used as a power window switch for the vehicle. Further, the pushbutton switch element of the present invention generates a click which is felt by a user at substantially the same level as the conventional mechanical switch while eliminating disadvantages of the mechanical switch such as an increase in number of parts, complication in structure, an increase in height and the like. In addition, the pushbutton switch element of the present invention permits a significant reduction in thickness thereof.

The invention will be understood more readily with reference to the following examples; however, these examples are intended to illustrate the invention and are not to be construed to limit the scope of the invention.

EXAMPLE 1

2 phr (parts per hundred parts of rubber) by weight of a vulcanizing agent manufactured under a tradename "C-8" by Shin-Etsu Chemical Co., Ltd. was added to a silicone rubber compound manufactured under a tradename "KE-961U" by Shin-Etsu Chemical Co., Ltd. to make a mixture, which was kneaded. Then, the mixture kneaded was sheeted and cut into predetermined dimensions, resulting in a starting sheet material being obtained. Then, the sheet was charged into a two-piece type compression mold and subjected to forming while being heated for 5 minutes at a temperature of 180° C., to thereby provide a base material for a pushbutton switch element made of a rubber elastomer.

The base material thus obtained was formed with a first projection for a first movable contact in a manner to be positioned at a center of a lower surface of a dome section thereof. Also, the base material was formed with a second projection having an annular shape for a second movable contact in a manner to be spaced by a distance of 2.5 mm from the first projection while surrounding the first projection. Then, the second projection had a conductive carbon ink printed thereon by silk screening, to thereby form a second movable contact.

Figure 7A:
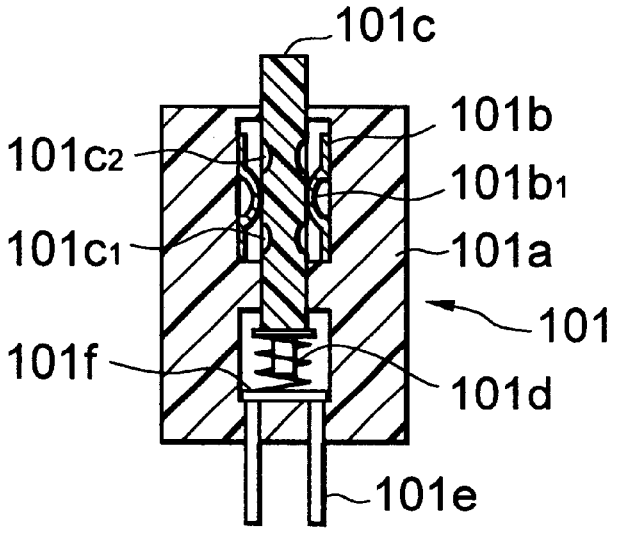
FIG. 7A PRIOR ART
FIG. 7A is a sectional view showing a conventional mechanical switch.
Figure 9A:
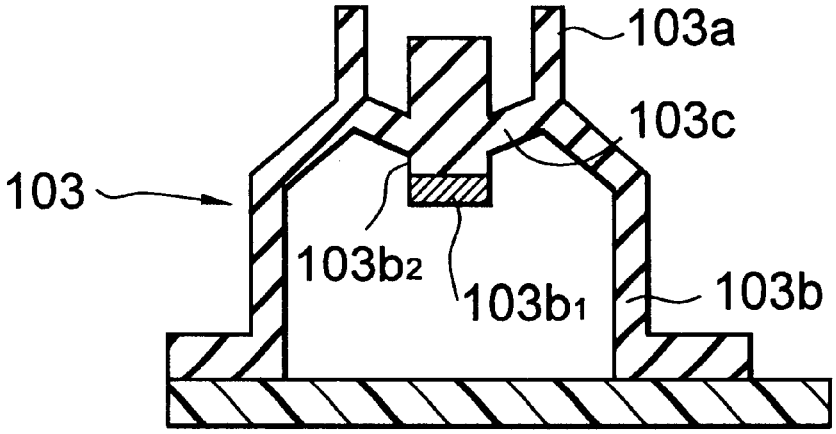
FIG. 9A PRIOR ART
FIG. 9A is a sectional view showing a conventional pushbutton switch cover member for a word processor.

Then, a dish-shaped metal spring made of stainless steel SUS 304 and manufactured by FUJIKURA LTD. was adhered to a distal end of the first projection by means of an adhesive manufactured under a tradename "SUPER X" by CEMEDINE CO., LTD. so as to form a second movable contact, resulting in a pushbutton switch element of the present invention which generates a click in a two-stage manner being provided. Specifications of the thus-obtained pushbutton switch element are shown in lines of between "configuration" and "dome angle" in Table 1. Also, characteristics of the switch element are shown in lines of between "load" and "resonance" in Table 1. For comparison, a conventional mechanical switch constructed as shown in FIG. 7A (Comparative Example 1) and a conventional ribbed switch made of a rubber elastomer and constructed as shown in FIG. 9A (Comparative Example 2) were provided. In this connection, the term "dome angle" indicates an angle at which the dome section rises from a horizontal base section of the pushbutton switch element.

TABLE 1

Figure 7B:
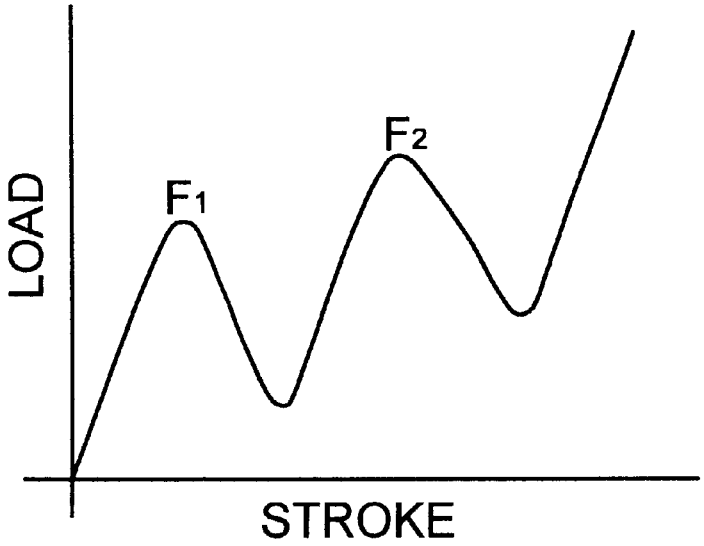
FIG. 7B is a graphical representation showing a load curve obtained by the mechanical switch shown in FIG. 7A.
Figure 9B:
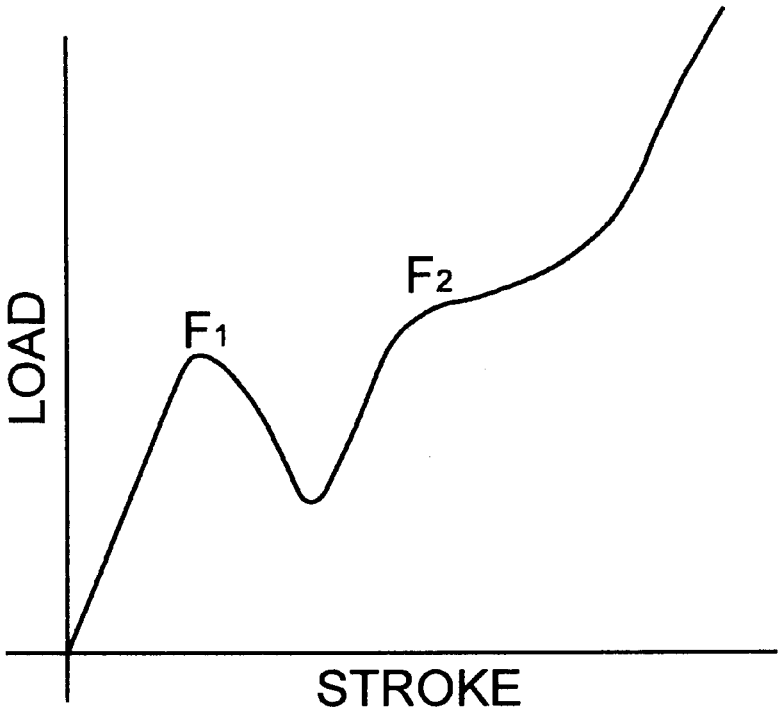
FIG. 9B is a graphical representation showing a load curve obtained by the pushbutton switch cover member of FIG. 9A.

| Item | Example 1 | Comparative Example 1 | Comparative Example 2 |
|---|---|---|---|
| Configuration of switch element | silicone (FIG. 2) | mechanical switch (FIG. 7) | silicone (FIG. 9) |
| Shape of contact | | | |
| first | dish-shaped metal spring | metal spring | circular |
| second | annular with 1 mm width | metal spring | — |
| External dimension of switch element | Φ 13 mm | 12 mm × 12 mm | Φ 13 mm |
| Diameter of contact | | | |
| first | Φ 5 mm (dish-shaped metal spring) | — | Φ 3 mm (carbon printing) |
| second | Φ 8 mm (carbon printing) | — | — |
| Thickness of dome section | 1.2 mm | — | 1.2 mm |
| Dome angle (degree) | 85 | — | 85 |
| Load (gf) | | | |
| Point $F_1$ | 75 | 180 | 77 |
| Point $F_2$ | 220 | 280 | 80 |
| Click ratio C (%) | | | |
| Point $F_1$ | 45 | 55 | 46 |
| Point $F_2$ | 47 | 46 | none (difficult to measure) |
| Sound during operation (dB) | 43 | 83 | 23 |
| Resonance | none | existence | none |

Figure 5:
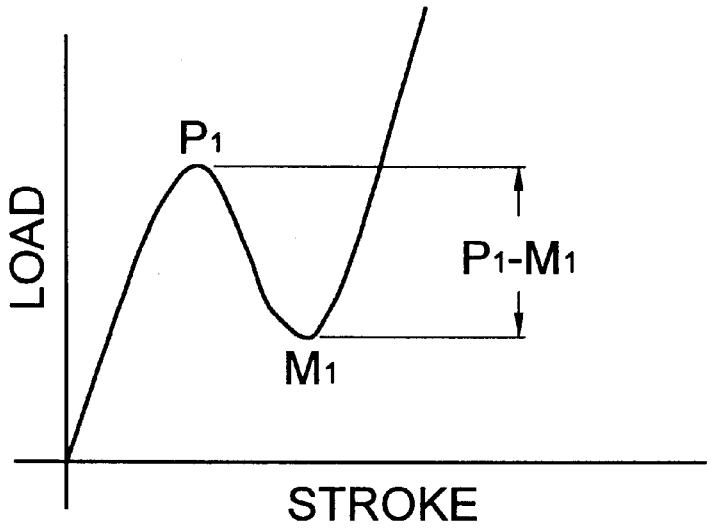
FIG. 5 is a graphical representation showing calculation of a click ratio based on a load curve.
Figure 6:
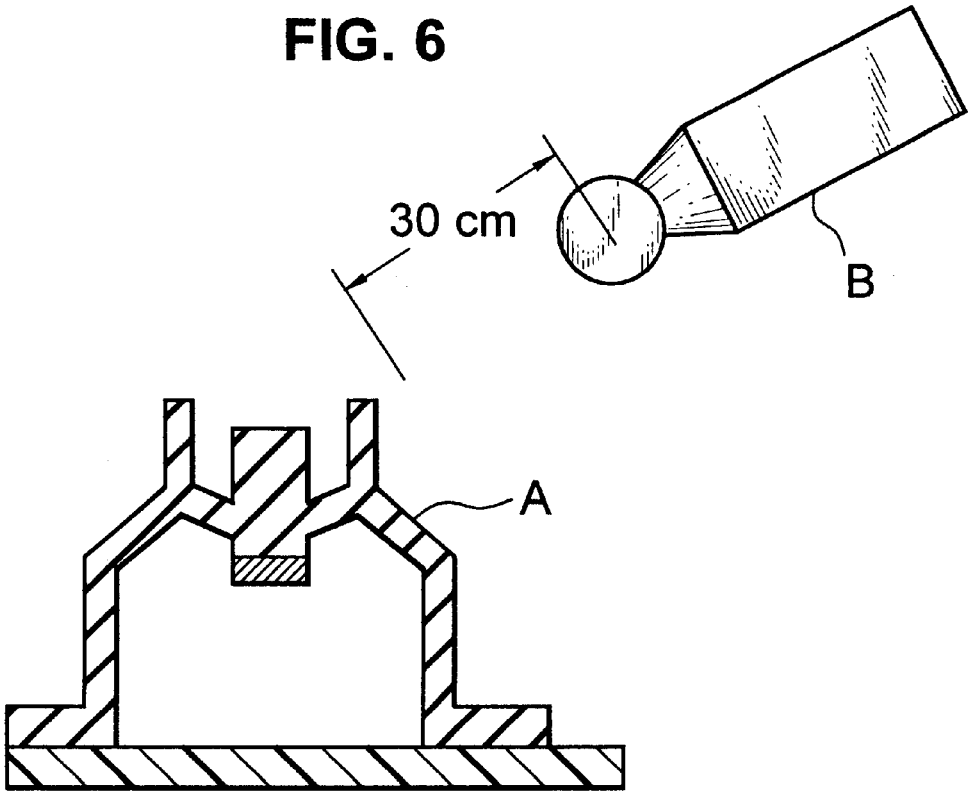
FIG. 6 is a schematic view showing measurement of sound generated during operation of a pushbutton switch.

FIG. 5 shows calculation of a click ratio based on a load curve and FIG. 6 shows measuring of sound generated during a switching operation.

The click ratio C (%) shown in Table 1 is generally represented by $C=(P_1-M_1)/P_1\times 100$ as shown in FIG. 5. The measuring was carried out using a load measuring device manufactured by Shin-Etsu Polymer Co., Ltd. and an X-Y recorder. Also, for the measuring, conditioning of each of the switch elements was carried out by subjecting each of the switch elements to a pressing operation three times under load of 500 gf before the measuring. A head or tip of the load measuring device was formed of ABS and had a flat end of a diameter of 3 mm and each switch element was held at an outer periphery thereof on a support of the device by means of magnets. Also, sound generated during operation of each switch element A was measured by a sound level meter B ( Model #5111 manufactured by ONO SOKKI CO., LTD.) while spacing the switch element 30 cm from the sound level meter, as shown in FIG. 6. The resonance sound was determined by the operator's ears.

As will be noted from Table 1, the switch element of the present invention (Example 1) was reduced in sound generation as compared with the switch of Comparative Example 1 and exhibited no resonance. Also, the switch element of the present invention generated an enhanced click which was felt by an operator as compared with Comparative Example 2.

EXAMPLE 2

7 phr by weight of a cross-linking agent manufactured under a tradename "Di Cup 40C." by Mitsui Chemicals, Inc. was added to EPDM manufactured under a tradename "EPT 3070" by Mitsui Chemicals, Inc., to thereby prepare a compound, which was sheeted and cut into predetermined dimensions, resulting in a starting sheet material being obtained. Then, the sheet was charged into a compression mold and subjected to forming while being heated for 5 minutes at a temperature of 160° C., to thereby provide a base material for a pushbutton switch element made of a rubber elastomer.

The base material thus obtained was formed with a first projection for a first movable contact in a manner to be positioned at a center of a lower surface of a dome section thereof. Also, the base material was formed with an annular second projection for a second movable contact in a manner to be spaced by a distance of 2.5 mm from the first projection while surrounding the first projection. Then, the second projection had a conductive carbon ink printed thereon by silk screening to thereby form a second movable contact.

Figure 8:
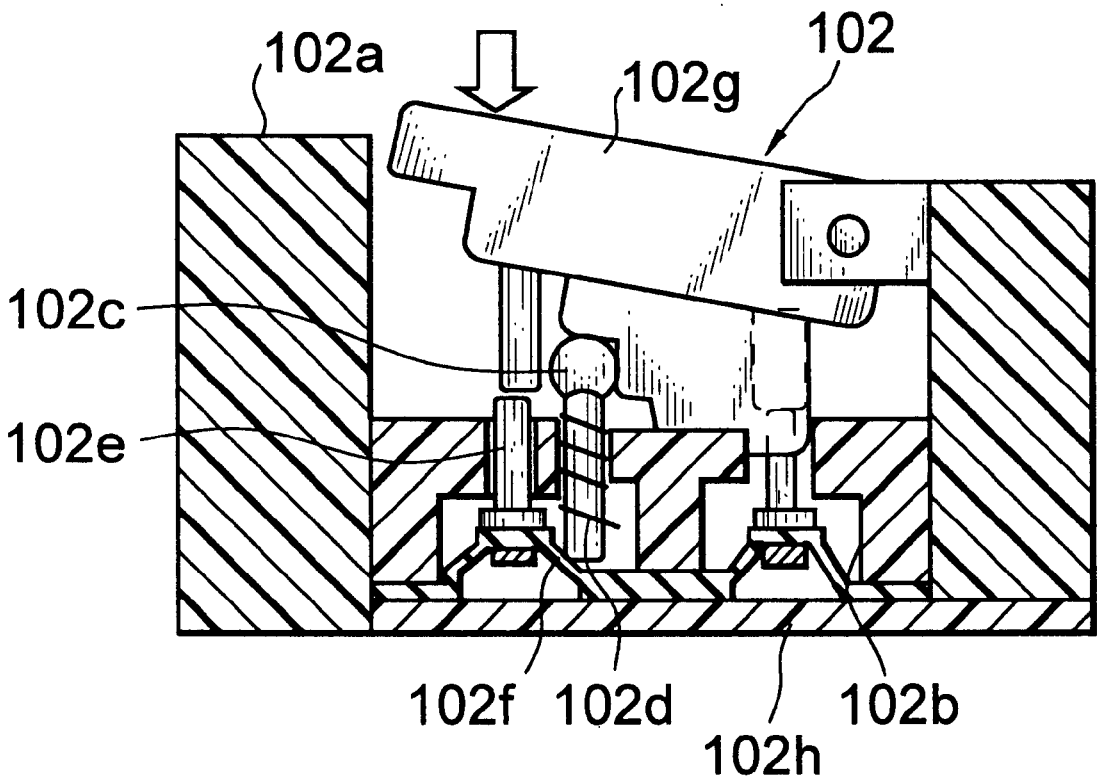
FIG. 8 PRIOR ART
FIG. 8 is a schematic sectional view showing another conventional mechanical switch.

Then, a formed article made of a polyester thermoplastic elastomer manufactured under a tradename "Hytrel" by DU PONT-TORAY CO., LTD. and having a dome-like shape of a small-diameter had a conductive carbon ink printed on an inner surface thereof so as to form a contact pattern. The formed article was adhered to a distal end of the first projection by means of an adhesive manufactured under a tradename "SUPER X" by CEMEDINE CO., LTD. so as to form a first movable contact, resulting in a pushbutton switch element of the present invention which generates a click in a two-stage manner being provided. Specifications of the thus-obtained pushbutton switch element are shown in lines of between "configuration" and "dome angle" in Table 2. Characteristics of the pushbutton switch element are shown in lines of between "load" and "resonance" in Table 2. For comparison, a conventional mechanical switch constructed as shown in FIG. 8 (Comparative Example 3) and a conventional ribbed switch element made of a rubber elastomer and constructed as shown in FIG. 9A (Comparative Example 4) were provided.

TABLE 2

| Item | Example 2 | Comparative Example 3 | Comparative Example 4 |
|---|---|---|---|
| Configuration of switch element | EPDM (FIG. 2) | mechanical switch (FIG. 8) | EPDM (FIG. 9) |
| Shape of contact | | | |
| first | dome-like spring made of elastomer "Hytrel" | metal spring/ polyacetal | circular |
| second | intermittent annular with 1 mm width | | — |
| External dimension of switch element | Φ 13 mm | 12 mm × 12 mm | Φ 13 mm |
| Diameter of contact | | | |
| first | Φ 3 mm (dome-like spring/carbon printing) | — | Φ 3 mm (carbon printing) |
| second | Φ 8 mm (carbon printing) | — | — |
| Thickness of dome section | 1.2 mm | — | 1.2 mm |
| Dome angle (degree) | 85 | — | 85 |
| Load (gf) | | | |
| Point $F_1$ | 200 | 430 | 82 |
| Point $F_2$ | 85 | 680 | 90 |
| Click ratio C (%) | | | |
| Point $F_1$ | 42 | 48 | 46 |
| Point $F_2$ | 48 | 47 | difficult to measure |
| Sound during operation (dB) | 36 | 99 | 25 |
| Resonance | none | existence | none |

As will be noted from Table 2, the pushbutton switch element of the present invention (Example 2) is reduced in generation of sound during operation thereof as compared with the switch of Comparative Example 3 and exhibited no resonance sound. Also, the switch element of the present invention generated an enhanced click which was felt by an operator as compared with Comparative Example 4.

EXAMPLE 3

In the example, a pushbutton switch element of the present invention, which is applied to a power window switch structure for an automobile and constructed in such a manner as shown in FIGS. 6A and 6B, was provided. More particularly, 2 phr by weight of a vulcanizing agent manufactured under a tradename "C-8" by Shin-Etsu Chemical Co., Ltd. was added to a silicone rubber compound manufactured under a tradename "DY-32-6014" by Dow Corning Toray Silicone Co., Ltd. to make a mixture, which was kneaded. Then, the mixture kneaded was sheeted and cut into predetermined dimensions, resulting in a starting sheet material being obtained. Then, the sheet was charged into a two-piece type compression mold and subjected to forming while being heated for 5 minutes at a temperature of 180° C., to thereby provide a base material for a pushbutton switch element made of a rubber elastomer.

Then, a colored silicone ink was deposited or plane-printed by a thickness of 10 microns on a top surface of a pressing section or key top of the thus-provided pushbutton switch base material by screen printing. Then, a light-blocking silicone paint was uniformly applied to the top surface of the key top of the base material so as to form a layer having a thickness of 50 microns, followed by curing of the paint. Thereafter, a laser beam was irradiated in the form of a character onto the top surface of the key top by means of a laser processing machine manufactured by FUJI ELECTRIC CO., LTD., leading to removal of only the light-blocking layer, resulting in the character being formed on the top surface.

The base material thus obtained was formed with a central projection for a first or central movable contact in a manner to be positioned at a center of a lower surface of each pressing section thereof. Also, the base material was formed with an annular projection for a second movable contact in a manner to be spaced by a distance of 2.5 mm from the central projection while surrounding the central projection. Then, the annular projection had a conductive carbon ink printed thereon by silk screening so as to form a second movable contact.

Then, a dish-shaped metal spring made of stainless steel SUS 304 and manufactured by FUJIKURA LTD. was adhered to a distal end of the central projection by means of an adhesive manufactured under a tradename "SUPER X" by CEMEDINE CO., LTD., resulting in a pushbutton switch element of the present invention which generates a click in a two-stage manner being obtained. Table 3 shows results obtained by applying each of the thus-obtained pushbutton switch element of the present invention and a mechanical switch (Comparative Example 5) to a power window of an automobile manufactured under a tradename "DIAMANTE" by MITSUBISHI MOTORS CORPORATION.

TABLE 3

| | Height of Component | |
|---|---|---|
| Component | Example 3 | Comparative Example 5 |
| Key top | 3 mm | 18 mm |
| Plunger | — | 2 mm |
| Frame | — | 6 mm |
| Rubber cover member | — | 4 mm |
| Metal spring/slide member | — | 0 |
| Base plate | 2 mm | 2 mm |
| Total | 5 mm | 32 mm |

In the switch of Comparative Example 5, the plunger was partially incorporated into the key top and the metal spring/slide member were incorporated into the frame. Therefore, the heights of the plunger and the metal spring/slide member shown in Table 3 are effective heights which affect the whole height of an assembled switch module. As will be noted from Table 3, the switch of the present invention attained a significant reduction in whole height of a switch module as compared with that of Comparative Example 5.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A pushbutton switch element for a pushbutton switch structure, comprising:

a movable thin wall section;

a pushbutton section formed on an upper portion of a center of said movable thin wall section;

a first movable contact arranged so as to downwardly extend from a lower surface of said pushbutton section;

a second movable contact having a substantially annular shape and arranged so as to downwardly extend from said lower surface of said pushbutton section and surround said first movable contact while being spaced from said first movable contact at a predetermined interval; and an inverted cup-like member adhesively attached to a distal end of said first movable contact and constructed so as to repeatedly carry out a flex operation between a flexed state and an original state restored from said flexed state while concurrently generating a click which is felt by a user.

2. A pushbutton switch element as defined in claim 1, wherein said second movable contact is formed to be an annular shape in a continuous manner.

3. A pushbutton switch element as defined in claim 1, wherein said second movable contact is formed to be a substantially annular shape in an intermittent manner.

4. A pushbutton switch element as defined in claim 1, wherein said inverted cup-like member is made of metal.

5. A pushbutton switch element as defined in claim 1, wherein said inverted cup-like member is made of synthetic resin.

6. A pushbutton switch element as defined in claim 1, wherein said movable thin wall section and said pushbutton section are integrally molded of a rubber elastomer material.

7. A pushbutton switch element as defined in claim 6, wherein said movable thin wall section is configured to have a dome-like shape.

8. A pushbutton switch element as defined in claim 7, wherein said first movable contact downwardly extends beyond said second movable contact.

9. A pushbutton switch element as defined in claim 7, wherein said second movable contact downwardly extends beyond said first movable contact.

10. A pushbutton switch element as defined in claim 6, wherein said first movable contact downwardly extends beyond said second movable contact.

11. A pushbutton switch element as defined in claim 6, wherein said second movable contact downwardly extends beyond said first movable contact.

12. A pushbutton switch element as defined in claim 6, wherein said first and second movable contacts downwardly extend to substantially the same level.

13. A pushbutton switch element as defined in claim 1, wherein said movable thin wall section is configured to have a dome-like shape.

14. A pushbutton switch element as defined in claim 13, wherein said first movable contact downwardly extends beyond said second movable contact.

15. A pushbutton switch element as defined in claim 13, wherein said second movable contact downwardly extends beyond said first movable contact.

16. A pushbutton switch element as defined in claim 1, wherein said first movable contact downwardly extends beyond said second movable contact.

17. A pushbutton switch element as defined in claim 1, wherein said second movable contact downwardly extends beyond said first movable contact.

18. A pushbutton switch element as defined in claim 1, wherein said first and second movable contacts downwardly extend to substantially the same level.

* * * * *